US006964351B2

(12) United States Patent
Jablonski et al.

(10) Patent No.: US 6,964,351 B2
(45) Date of Patent: Nov. 15, 2005

(54) ICE DISPENSING CHUTE

(75) Inventors: Thaddeus M. Jablonski, Palatine, IL (US); Michael J. Scheurich, Elgin, IL (US)

(73) Assignee: IMI Cornelius, Inc., Anoka, MN (US)

( * ) Notice: Subject to any disclaimer, the term of this patent is extended or adjusted under 35 U.S.C. 154(b) by 0 days.

(21) Appl. No.: 10/825,576

(22) Filed: Apr. 15, 2004

(65) Prior Publication Data

US 2005/0006406 A1 Jan. 13, 2005

Related U.S. Application Data

(60) Provisional application No. 60/463,771, filed on Apr. 17, 2003.

(51) Int. Cl.[7] ..... B67D 5/62

(52) U.S. Cl. ..... 222/146.6; 222/505; 141/82; 141/362

(58) Field of Search ..... 222/129.1, 146.6, 222/505, 559; 141/82, 360, 362; 251/252

(56) References Cited

U.S. PATENT DOCUMENTS 5,437,391 A * 8/1995 Landers et al. ..... 222/1
6,059,149 A * 5/2000 Kanzler et al. ..... 222/238
6,135,173 A * 10/2000 Lee et al. ..... 141/361
2003/0230108 A1 * 12/2003 Lucas et al. ..... 62/344
2004/0187516 A1 * 9/2004 Lee ..... 62/389

* cited by examiner

*Primary Examiner*—Joseph A. Kaufman
(74) *Attorney, Agent, or Firm*—Pyle & Piontek

(57) ABSTRACT

An ice dispensing chute mechanism is characterized by an ice chute adapted for attachment at an upper ice inlet end to an ice retaining bin at an ice outlet from the bin. An actuating arm is pivotally mounted on the ice chute and has a lower end for being contacted and moved by a receptacle into which ice is to be dispensed from a lower ice discharge end of the chute and an upper end for contacting and moving a linkage mechanism upon rotation of the actuating arm by the receptacle. The linkage mechanism is pivotally mounted on the ice chute and is coupled to an ice gate that is linearly moved by the linkage mechanism between open and closed positions that establish and interrupt communication between the upper inlet to the chute and the ice outlet opening from the bin. Movement of the linkage mechanism by the actuating arm operates the linkage mechanism to translate the rotational movement of the actuating arm into linear movement of the ice gate between its open and closed positions to dispense ice and to cease dispensing ice into the receptacle. The ice chute consists of two halves that snap together in a releasable manner to permit easy disassembly of the ice chute for cleaning, repair or replacement of parts. The upper inlet to the ice chute is configured to impart to ice particles a trajectory through the chute that guides the ice particles into the receptacle while preventing the vast majority of the ice particles from contacting interior surfaces of the chute.

21 Claims, 7 Drawing Sheets

ICE DISPENSING CHUTE

This application claims benefit of provisional application Ser. No. 60/463,771, filed Apr. 17, 2003.

BACKGROUND OF THE INVENTION

The present invention relates generally to ice dispensing equipment and in particular to ice dispensing equipment for dispensing ice into a cup.

Ice dispensing equipment is well known and generally employs an ice retaining bin and an ice chute connected thereto. Ice is dispensed from the bin through the chute and into a suitable receptacle. Dispensing of ice is typically initiated by actuation of a switch which operates an electrically driven dispensing mechanism. Particularly in equipment which combines the dispensing of ice and beverages, the ice dispensing mechanism consists of an agitator that agitates ice retained in the bin to prevent congealing and agglomeration of the discrete particles of ice into a mass of ice and to keep the discrete particles in free flowing form and that, during an ice dispensing operation, moves and lifts the ice to and through an ice outlet opening in the bin so that the ice can fall under the force of gravity down and out of the ice chute into a receptacle held beneath the chute. An ice door or gate is used to control passage of ice through the bin outlet opening, such that the gate opens the bin opening when ice is to be dispensed and closes the opening to block further passage of ice through the opening when the desired amount of ice has been dispensed. It is known to operate or power the ice gate between open and closed positions with a solenoid, but that approach adds undesirable cost to the ice dispenser. Purely manually operated ice gate mechanisms are also known, but such gates are subject to issues such as mechanical complexity, difficulty of disassembly and cleaning, lack of reliability and an inability to provide sufficient mechanical advantage for reasonable manual operation of the mechanism. Some manual dispense systems require movement of the chute itself, but that approach introduces errors relative to accurately targeting the ice pieces into a receptacle. It would therefore be desirable to have a manually powered and operated ice dispensing system that operates effectively, is low in cost and mechanically simple and easy to clean, and that provides for an enhanced flow of ice and targeting of ice accurately into a receptacle.

SUMMARY OF THE INVENTION

In accordance with the present invention, there is provided an improved ice dispensing chute assembly which includes an ice chute that is secured to an ice retaining bin and has an actuation lever pivotally secured thereto. A crank and slider linkage mechanism is operated by the actuation lever for opening an ice gate. The linkage mechanism efficiently and directly translates a pivotal rotary motion of the actuation lever into a linear motion for lifting the ice gate. The ice chute has a top half and a bottom half that can easily be separated for cleaning purposes and the chute is provided with a sloped ice launch ramp over which ice discharged from the ice bin flows and that allows the ice to fall through the chute in a generally uniform trajectory over a predictable range of velocities. The ice chute is sized to permit a parabolic flight for the individual ice particles over the predictable range of velocities so that most of the ice particles do not touch the inner surfaces of the ice chute and there is accurate targeting of ice into a receptacle held beneath the chute. The ice delivered into the receptacle advantageously is somewhat less wet and less melted by virtue of not having to come into heat exchange contact with the chute.

OBJECT OF THE INVENTION

A primary object of the present invention is to provide an improved manually operated ice dispensing chute assembly that is efficient in operation, mechanically simple, easy to clean and provides an enhanced flow of ice through a chute and accurate targeting of ice particles into a receptacle.

DETAILED DESCRIPTION

Figure 1:
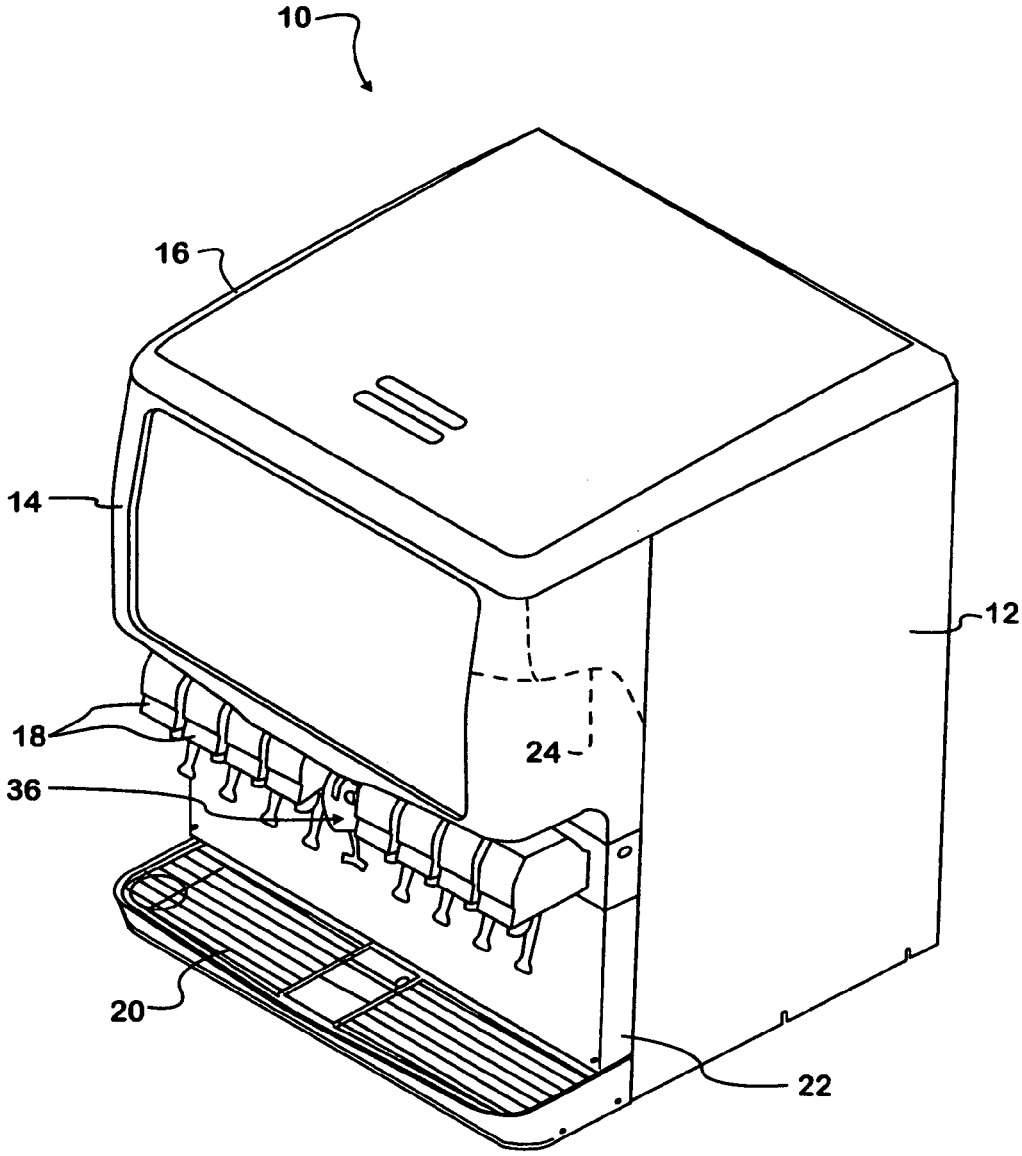
FIG. 1 is a perspective view of an ice and beverage dispenser of a type with which the ice dispensing chute assembly of the present invention may be used.

An ice dispensing chute assembly according to the teachings of the present invention is advantageous for use in a combined beverage and ice dispensing machine of a type shown in FIG. 1 and indicated generally at 10. As is conventional, the dispenser 10 includes an outer housing 12, a merchandising cover 14 and a removable ice bin filling cover 16. A plurality of beverage dispensing valves 18 is secured to a front surface of the dispenser above a drip tray 20 and adjacent a splash panel 22, and internally of the dispenser is an ice retaining bin 24.

Figure 2:
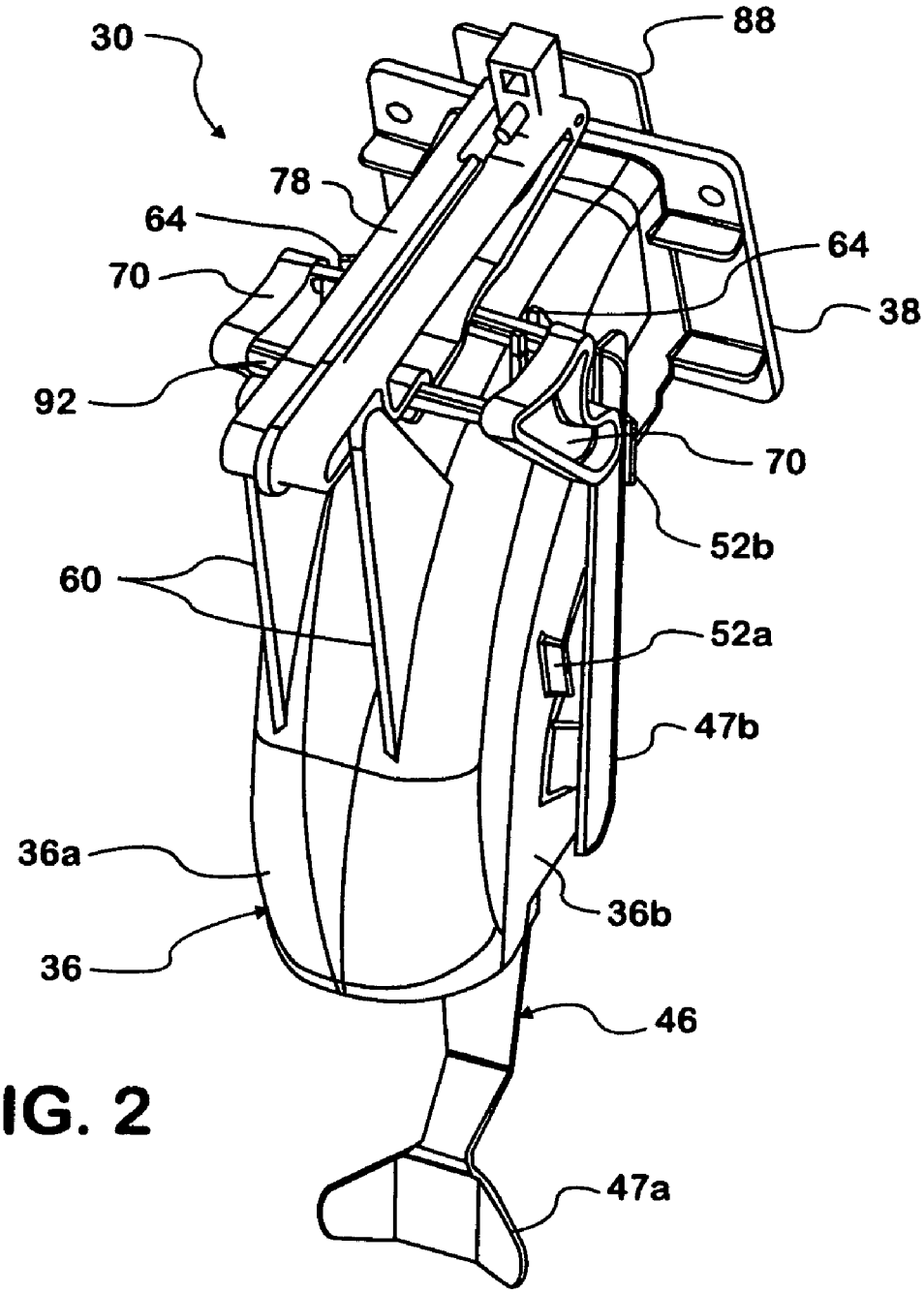
FIG. 2 is an enlarged perspective view of the ice dispensing chute assembly.
Figure 3:
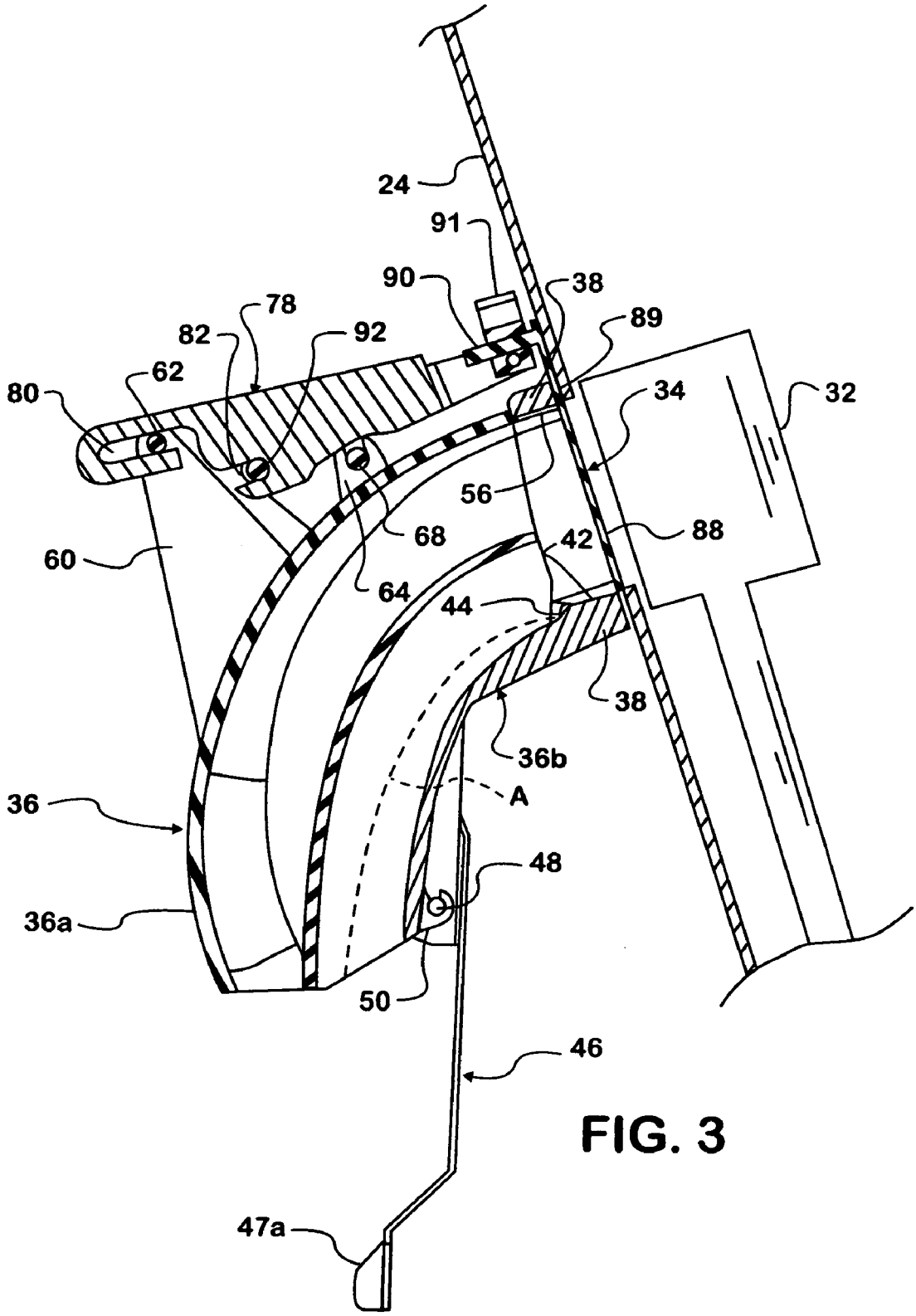
FIG. 3 is a cross-sectional side elevation view of the ice dispensing chute assembly.

As seen in FIGS. 2 and 3, an ice dispensing chute assembly embodying the teachings of the invention is indicated generally at 30 and mounted to an upper front portion of the ice bin 24. A conventional rotary ice lifting mechanism is in the ice bin 24 and includes ice lifting arm ends 32 (one of which is shown) that move ice particles from a lower level in the ice bin up to an elevated ice dispense outlet opening 34 from the ice bin. The ice dispensing chute assembly 30 includes an ice chute, indicated generally at 36, having a top or upper part or half 36*a* and a bottom or lower part or half 36*b*. The chute bottom part 36*b* has an ice gate frame portion 38 which is secured to the ice bin 24 at and around the ice outlet opening 34 to mount the ice dispensing chute assembly 30 to the ice bin. The chute bottom part also has an ice platform 42 and an inclined ice ramp 44 and an actuating arm, indicated generally at 46, is pivotally secured to the chute bottom part by a pin 48 of the actuating arm that extends through and is releasably received in retainers 50 that are integral with and extend from the chute bottom portion. The actuating arm 46 has a cup contacting lower end portion 47*a* and a pair of upper cam contacting arms 47*b*. The bottom chute part 36*b* is provided with a pair of stops 52*a* and 52*b* for limiting the range of pivotal motion of the actuating arm 46 by virtue of engaging and limiting the range of motion of one of the cam contacting arms 47*b*. To facilitate connection of the chute top part 36*a* to the chute bottom part 36*b*, the chute bottom part has a pair of clip latching extensions 54 on its opposite sides.

The top part 36*a* of the ice chute 36 has an upper tongue 56 and a pair of lower retaining clips 58 on its opposite sides that releasably engage with the clip latching extensions 54 on the bottom part 36*b* of the chute. The top ice chute part 36*a* also includes a pair of slider pin supports 60 between which a slider pin 62 extends as well as a pair of crank supports 64 adapted to releasably receive a pin 68 extending between a pair of cranks 70. Each crank 70 has a cam surface 72 and two pin lobes 74 and 76. The cranks 70 are pivotally secured to the chute top portion 36*a* by releasable receipt of the pin 68 in the pair of crank supports 64. An elongate slider arm 78 includes at one end a slide slot 80, an intermediate snap fitting pivot slot 82 and at an opposite end a pair of snap fitting pivot slots 84 for releasably receiving and retaining a pivot pin 86 that extends perpendicular to a length of the slider arm. An ice gate or door 88 is received for vertical linear sliding movement within a slot or recessed area 89 in a rear surface of the frame 38 and an extension pin 90 attached to an upper end of the ice gate 88 extends perpendicularly forward from the gate. A block 91 is pivotally attached to the pin 86 for rotation about the pin and is provided with a front to rear extending passage 91*a* that extends perpendicular to the pin 86 and receives the gate pin 90, whereby the block 91 is free to slide forward and backward along the gate pin 90. The slider pin 62 extending between the slider pin supports 60 of the chute top portion 36*a* extends through and is releasably retained in the slide slot 80 at the one end of the slider arm 78. A pin 92 extends between and is secured to each of the lobes 76 of the cranks 70 and intermediate the cranks the pin 92 extends through and is releasably retained in the snap fitting pivot slot 82 of the slider arm 78.

Figure 4A:
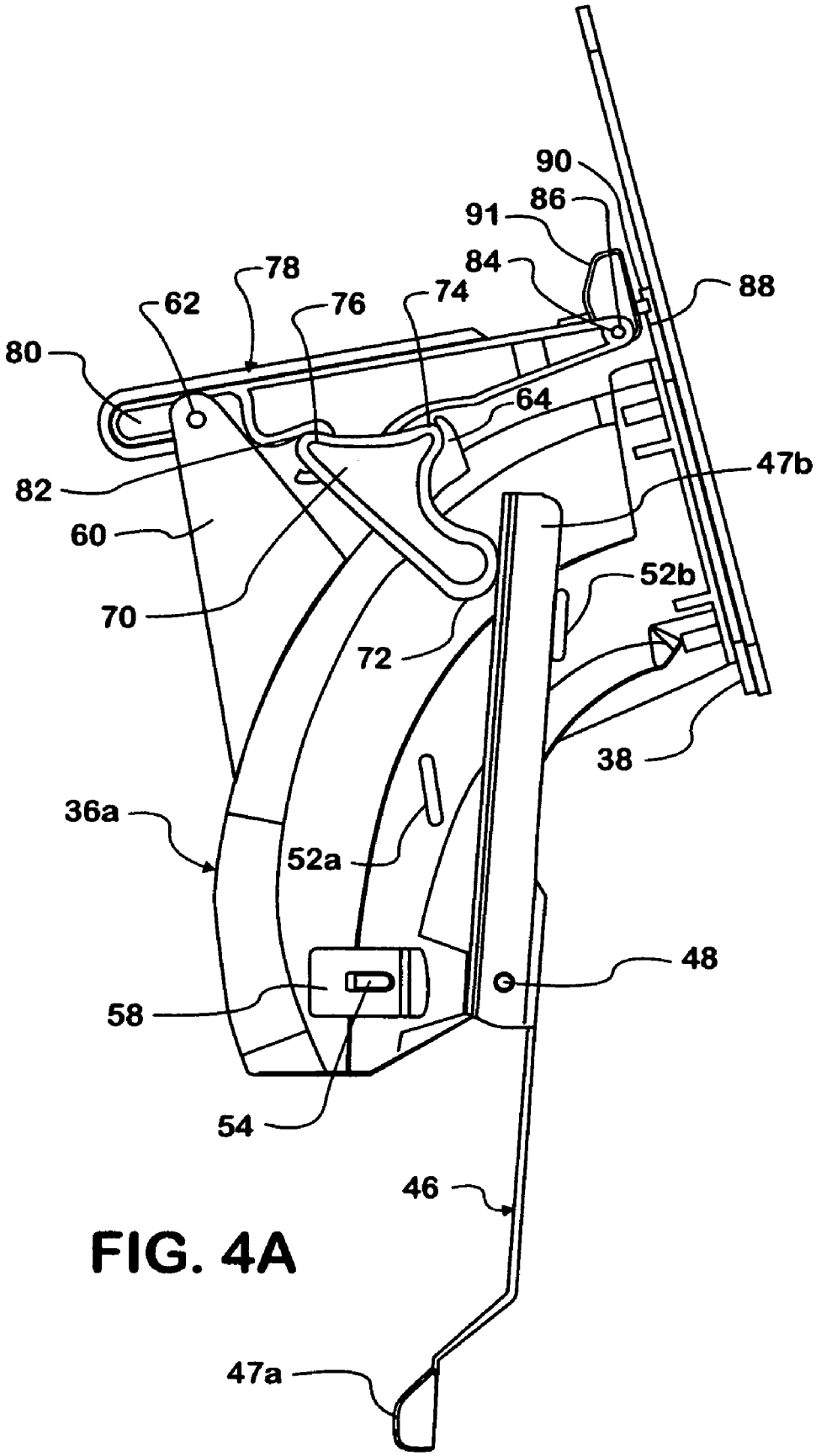
FIGS. 4A–C are sequential side plan views illustrating the operation of the ice dispensing chute assembly.
Figure 4B:
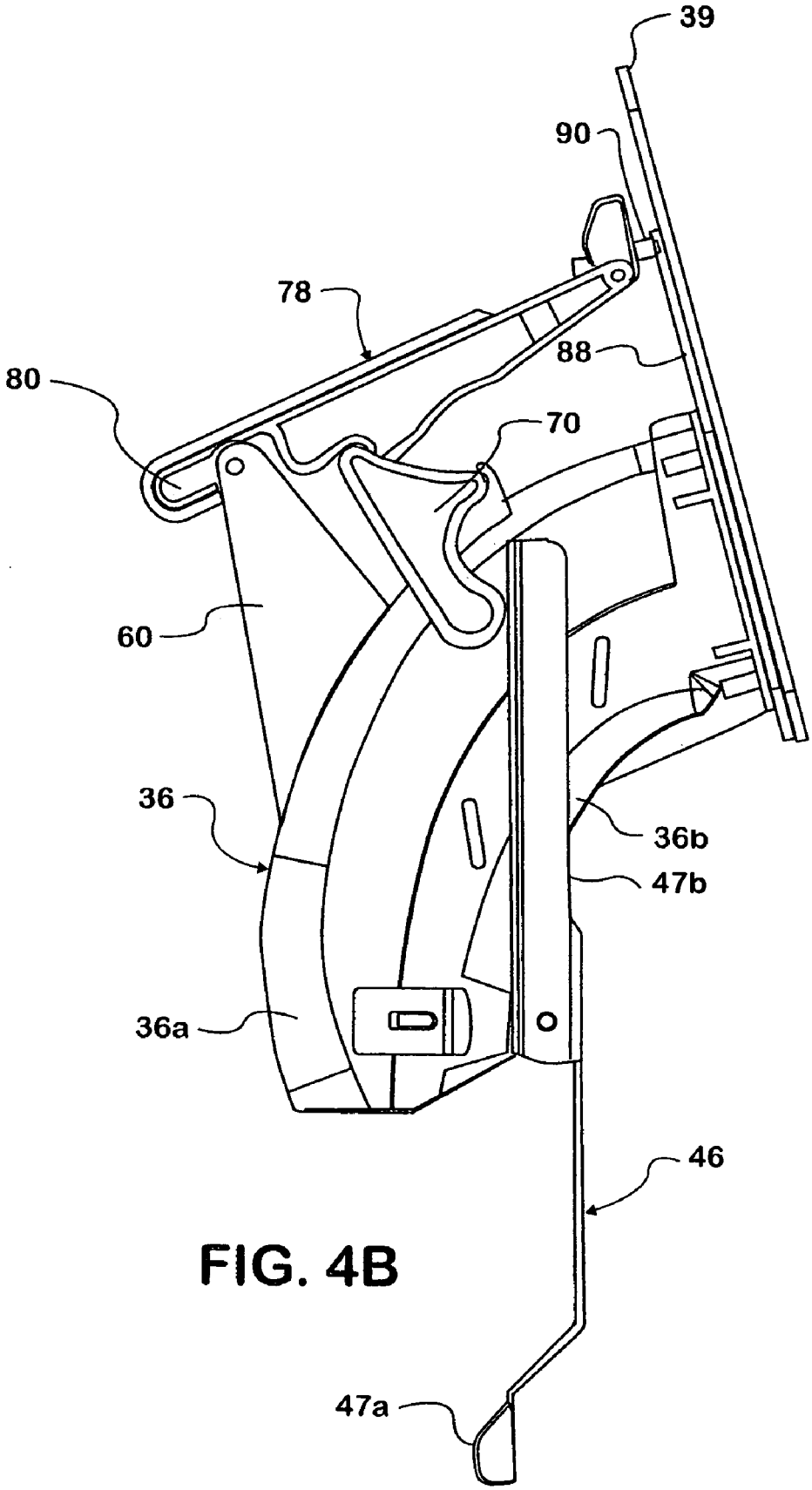
Figure 4C:
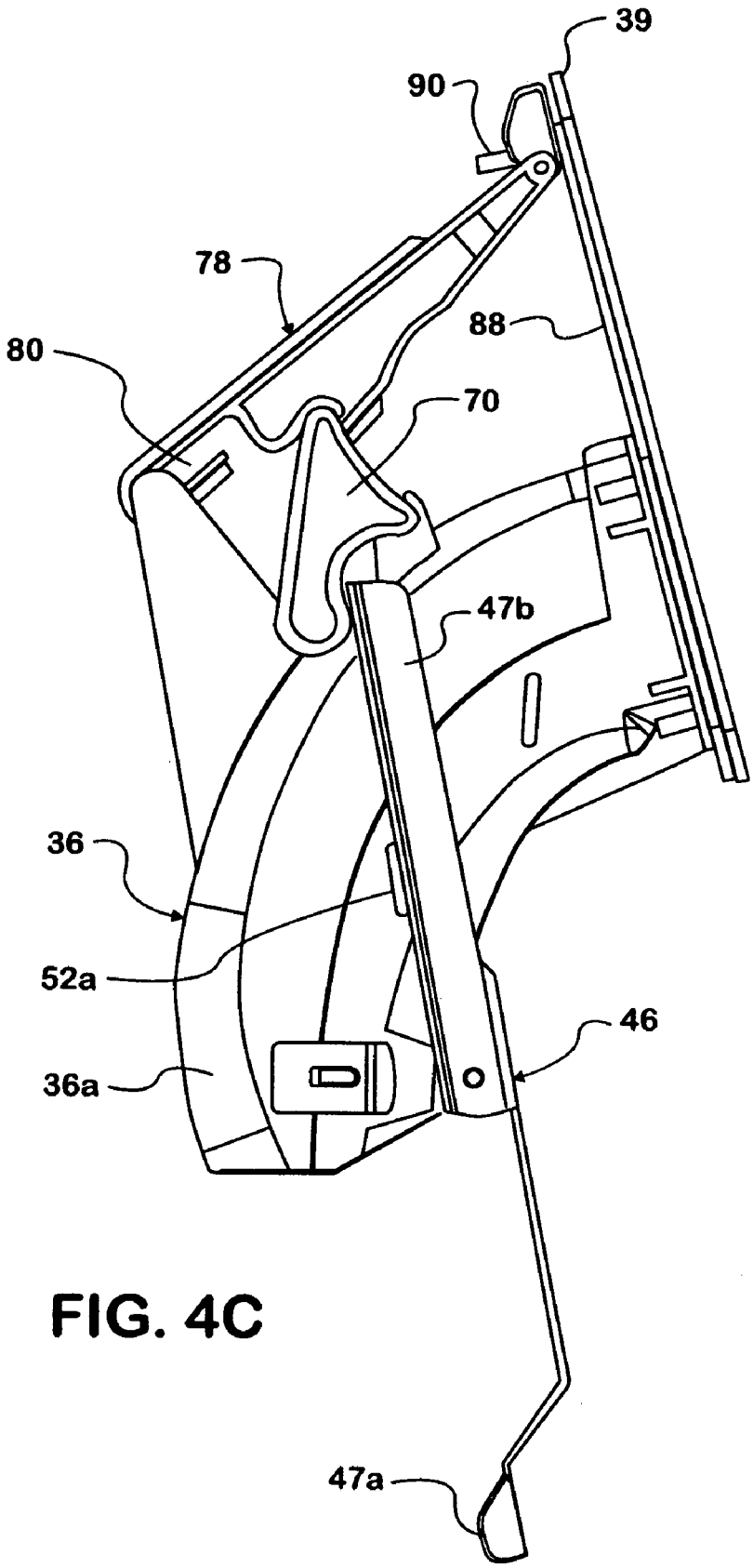

In operation of the ice dispensing system 30 and with reference to FIGS. 4A–C, a cup or other receptacle into which ice is to be dispensed is moved against the cup contacting lower end portion 47*a* of the actuating arm 46 with sufficient force to move the lower end rearward and pivot or rotate the actuating arm 46 counterclockwise (as viewed in FIGS. 4A–C) about the pin 48 carried in the chute retainers 50. Counterclockwise rotation of the actuating arm moves its contacting arms 47*b* against the cam surfaces 72 of the cranks 70, which pivots or rotates the cranks clockwise about the pin 68 that is retained in and between the crank supports 64 attached to the top chute portion 36*a*. Clockwise rotation of the cranks 70 about the pin 68 in turn, through the lifting action of the crank pin 92 on the slider arm 78, results in counterclockwise rotation of the slider arm 78 about the slider pin 62 carried by the supports 60 and extending through the slider arm slot 80. With counterclockwise rotation of the slider arm 78 about the slider pin 62 the ice gate 88, which is coupled to the rightward end of the slider arm through receipt of the ice gate pin 90 in the passage 91*a* through the block 91, is lifted and linearly moved from an ice gate closed position as seen in FIG. 4A, where the ice gate interrupts communication between the ice bin ice dispensing outlet 34 and the upper inlet to the ice chute 36, to an ice gate open position as seen in FIG. 4C, where the ice gate establishes communication between the ice bin ice dispensing outlet and the upper inlet to the ice chute. When the ice gate 88 has reached its open position, engagement of the actuating arm 47*b* with the stop 52*a* then limits further rotation of the actuating arm 46 and upward movement of the ice gate. During lifting and opening of the gate 88, the slider arm slot 80 that receives the pin 62, together with the passage 91*a* through the block 91 that receives the gate pin 90, take up the rotational movement of the slider arm 78 and permit a purely linear movement or lifting of the ice gate 88.

As is understood, movement of the actuator arm 46 to dispense ice into a cup will actuate an electrical switch (not shown) that operates the ice lifting mechanism located in the ice bin 24, so that its arms 32 then move ice particles to and out of the ice bin outlet opening 34 while the gate 88 is open. Ice exiting the ice bin 24 through the bin outlet opening 34 is pushed onto and across the platform 42 to the inclined ice launch ramp 44, along which ramp the ice particles slide under the influence of gravity as they enter the ice chute 36. As the ice pieces slide along the ramp, their velocity increases in a uniform manner, such that as the ice pieces leave the ramp and fall under the influence of gravity they follow a parabolic course through the ice chute as represented by a dashed line A in FIG. 3. The chute 36 is sized so that the vast majority of the ice particles will fall through the chute and directly into a receptacle being held beneath a lower outlet from the chute without contacting interior surfaces of the chute. By not contacting the chute interior surfaces while passing through the chute, the ice particles will follow a predictable trajectory directly into the receptacle, as opposed to possibly being deflected into a path that might cause some of the ice particles to miss the receptacle. When a desired quantity of ice has been dispensed into the receptacle, the receptacle is moved away from the lower end 47*a* of the actuating arm 46 to permit the actuating arm to rotate clockwise and close the ice gate 88, until further clockwise rotation of the actuating arm is arrested by engagement of its arm 47*b* with the stop 52*b*.

Figure 5:
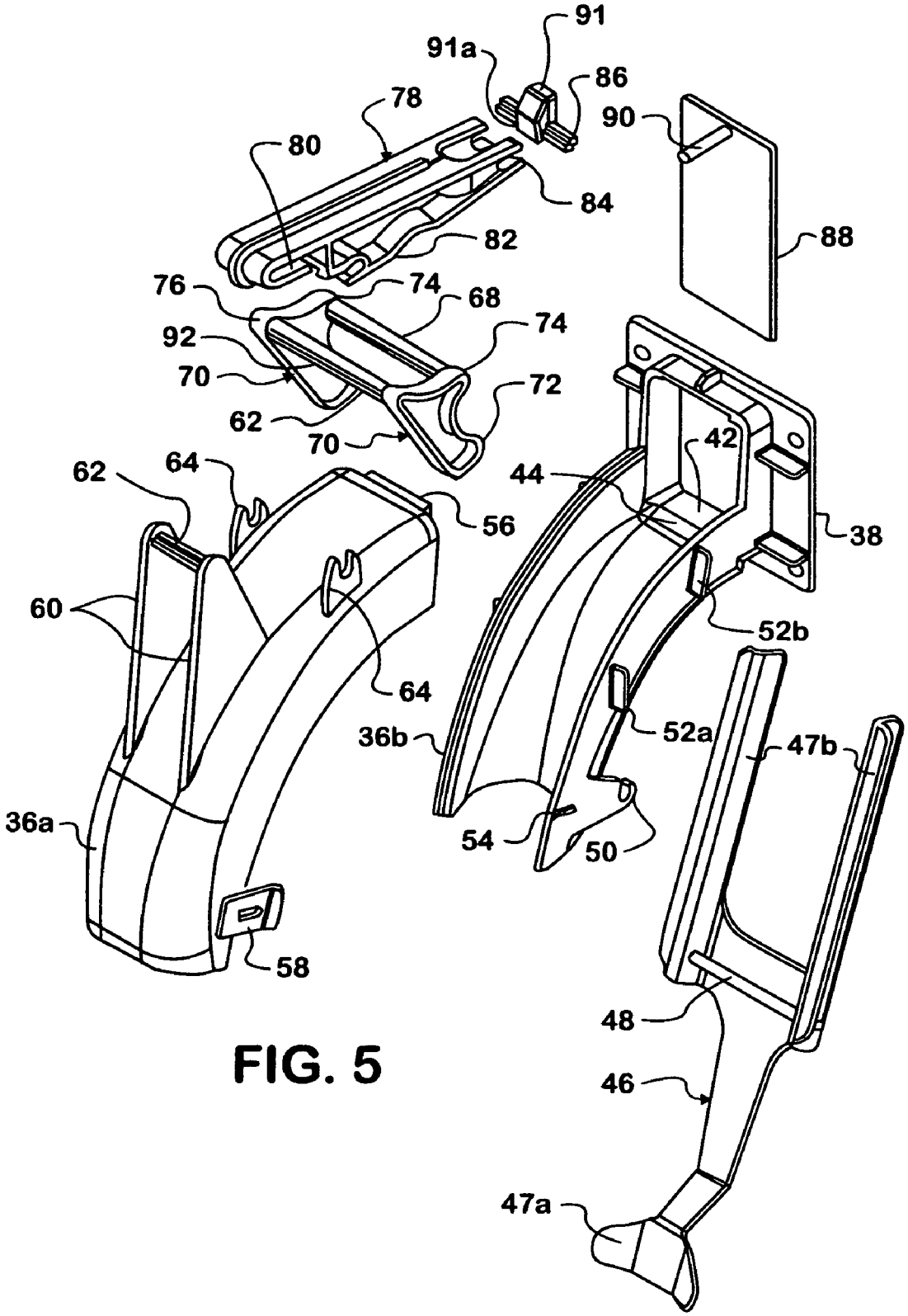
FIG. 5 is an exploded assembly view of the ice dispensing chute assembly.

The ice dispensing system 30 of the invention may readily be disassembled for cleaning, repair or replacement of parts. Referring to FIG. 5, the top part 36*a* of the ice chute 36 can easily be separated from the bottom part 36*b* by releasing the retaining clips 58 on each side of the top part from the corresponding latch extensions 54 on the bottom part and by sliding the tongue 56 of the top part of the chute out from beneath a top interior shoulder of the ice gate frame portion 38. The ice gate 88 can then simply be lifted out from the slot 89 of the frame portion 38, and if further disassembly is desired, the slider arm 78 can simply be disengaged from its releasable connection to the pins 62 and 92, and the cranks 70 can then be removed by lifting the pin 68 from its supports 64. Removal of the actuating arm 46 can then be accomplished by lifting its pin 48 from the retainers 50. By virtue of the novel structure of the ice chute assembly 30, its disassembly advantageously does not result in there being a large number of small and separate parts that can be misplaced and/or increase the difficulty of reassembling the ice chute.

While one embodiment of the invention has been described in detail, various modifications and other embodiments thereof may be devised by one skilled in the art without departing from the spirit and scope of the invention, as defined in the appended claims.

What is claimed is:

1. An ice dispensing chute assembly for dispensing ice into a receptacle, comprising:

an ice chute having a lower ice discharge end and an upper ice inlet end for being secured to an ice retaining bin at an ice outlet opening from the bin;

an actuating arm pivotally connected to said ice chute and having a cam contacting portion and a receptacle contacting portion for being contacted and moved by a receptacle into which ice is to be dispensed to pivot said actuating arm for rotation relative to said ice chute;

an ice gate retained at said ice chute upper inlet end for linear movement between open and closed positions to respectively establish and interrupt communication between said ice chute inlet end and the ice outlet opening from the ice retaining bin; and linkage mechanism means for being contacted and moved by said actuating arm cam contacting portion and coupled to said ice gate for linearly moving said ice gate between said open and closed positions, said linkage mechanism means translating rotational movement of said actuating arm into linear movement of said ice gate between said open and closed positions.

2. An ice dispensing chute assembly as in claim 1, said linkage mechanism means including crank means pivotally connected to said ice chute and for being contacted and rotated relative to said ice chute by said cam contacting portion of said actuating arm upon rotation of said actuating arm, elongate slider means pivotally and slidably connected toward one end thereof to said ice chute and coupled to said crank means intermediate said one end and an opposite end thereof for rotation of said slider means about said one end thereof upon rotation of said crank means, and means for coupling said opposite end of said slider means to said ice gate for linearly moving said ice gate between said open and closed positions in response to rotation of said slider means in first and second directions of rotation.

3. An ice dispensing chute assembly as in claim 2, wherein said means for coupling said opposite end of said slider means to said ice gate comprises a block pivotally attached to said opposite end of said slider means for rotation about an axis extending perpendicular to the plane of rotation of said slider means and having a passage extending therethrough parallel to the plane of rotation of said slider means, and a pin connected to said ice gate and received for lifting and sliding movement in said block passage.

4. An ice dispensing chute assembly as in claim 1, wherein said ice chute comprises upper and lower ice chute parts that are releasably secured together.

5. An ice dispensing chute assembly as in claim 1, wherein said upper end of said ice chute has a ramp across which ice particles from the ice bin flow for imparting to the ice particles a trajectory through and out of said discharge end of said chute such that the ice particles are guided to remain out of contact with inner surfaces of said chute.

6. An ice dispensing chute assembly for dispensing ice into a receptacle, comprising:

an ice chute having a lower ice discharge end and an upper ice inlet end for being secured to an ice retaining bin at an ice outlet opening from the bin;

an elongate actuating arm pivotally connected intermediate its length to a lower side of said ice chute and having cam contacting means at an upper end and receptacle contacting means at a lower end, said receptacle contacting means for being engaged and moved by an ice receiving receptacle that is manually moved against said lower end to rotate said actuating arm;

a crank assembly pivotally connected to an upper side of said ice chute and having crank arm means for being engaged and moved by said actuating arm cam contacting means to rotate said crank assembly upon rotation of said actuating arm;

ice gate means at said ice chute upper inlet end for linear movement between positions establishing and interrupting communication between the ice bin ice outlet opening and said ice chute inlet end; and elongate slider link means pivotally and slidingly connected toward one end to said upper side of said ice chute for pivotal and sliding movement about said one end relative to said ice chute, pivotally and slidingly connected toward an opposite end to said ice gate means for pivotal and sliding movement of said opposite end relative to said ice gate means and for linearly moving said ice gate means between said positions establishing and interrupting communication between the ice bin ice outlet opening and said ice chute inlet end, and pivotally connected intermediate its ends to said crank assembly so that, upon rotation of said crank assembly, said crank assembly acts upon said elongate slider link means to rotate said elongate slider link means about said one end and to linearly move said gate means at said opposite end of said elongate slider link means between said positions establishing and interrupting communication between the ice bin ice outlet opening and said ice chute inlet end, said linear sliding movement of said slider link means at said one end thereof relative to said ice chute and at said opposite end thereof relative to said ice gate means during rotation of said slider link means accommodating translation of the rotary motion of said crank assembly and said elongate slider link means to linear movement of said ice gate means.

7. An ice dispensing chute assembly as in claim 6, wherein said ice chute comprises separate upper and lower ice chute portions and means for releasably connecting together said upper and lower ice chute portions to form said ice chute.

8. An ice dispensing chute assembly as in claim 6, wherein said ice chute has a downward sloping ramp at said upper ice inlet end of said chute for receiving ice particles from the ice retaining bin ice outlet for gravity conveyance of the ice particles along and off of said ramp and through said ice chute to said lower ice discharge end of said ice chute, said ramp and ice chute being configured such that the majority of ice particles leaving said ramp have a parabolic trajectory of travel through said ice chute such that the ice particles do not contact inside surfaces of said ice chute before exiting said lower ice discharge end of said ice chute for flow into the receptacle.

9. An ice dispensing chute assembly as in claim 6, wherein said elongate actuating arm is pivotally connected to said lower side of said ice chute by a pin on one of said actuating arm and ice chute and by pin retainer means on the other of said actuating arm and ice chute, said pin being received and rotatable in said retainer means.

10. An ice dispensing chute assembly as in claim 9, wherein said pin is on said actuating arm and said pin retainer means is on said lower side of said ice chute.

11. An ice dispensing chute assembly as in claim 6, wherein said cam contacting means of said actuating arm comprises a pair of cam contacting arms on an upper side of said pivotal connection of said actuating arm to said ice chute and extending upward in spaced relationship for engaging, upon rotation of said actuating arm by a receptacle, corresponding surfaces of said crank assembly to rotate said crank assembly.

12. An ice dispensing chute assembly as in claim 6, wherein said crank assembly comprises a pair of cranks for being engaged and moved by said actuating arm cam contacting means and said crank assembly is pivotally connected to said ice chute by a pin on one of said crank assembly and ice chute and by retainer means on the other of said crank assembly and ice chute, said pin being received and rotatable in said retainer means.

13. An ice dispensing chute assembly as in claim 12, wherein said pin is on said crank assembly and extends between said pair of cranks.

14. An ice dispensing chute assembly as in claim 6, wherein said crank assembly includes a pin extending generally parallel to an axis of rotation of said crank assembly, and said elongate slider link means is pivotally connected intermediate its ends to said crank assembly by pivotal connection of said slider link means to said pin of said crank assembly.

15. An ice dispensing chute assembly as in claim 6, wherein said ice gate means comprises a generally planar plate that is linearly moved to a position across and closing said ice chute ice inlet end and a position remote from and opening said ice chute ice inlet end.

16. An ice dispensing chute assembly as in claim 15, wherein said ice gate means includes a pin extending outward from said planar plate, said pin being received by said opposite end of said elongate slider link means for being linearly moved thereby while accommodating relative sliding movement with respect thereto, whereby said slider link means linearly moves said pin and thereby linearly moves said ice gate means planar plate between said positions closing and opening said ice chute inlet end.

17. An ice dispensing chute assembly as in claim 6, wherein said elongate slider link means is pivotally and slidingly connected toward said opposite end thereof to said ice gate means by a block pivotally attached to said opposite end of said slider link means for rotation about an axis extending perpendicular to a plane of rotation of said slider link means and having a passage extending therethrough parallel to said plane of rotation of said slider link means, and by a pin of said ice gate means that is slidably received in said block passage.

18. An ice dispensing chute assembly as in claim 6, wherein said slider link means is pivotally and slidingly connected toward said one end thereof to said upper side of said chute by a pin on one of said slider link means and said ice chute and by a slide slot on the other of said slider link means and said ice chute, said pin being received for rotation and sliding movement in said slide slot.

19. An ice dispensing chute assembly as in claim 18, wherein said slide slot is on said slider link means and said pin is on said ice chute.

20. An ice dispensing chute assembly as in claim 6, wherein said elongate slider link means is pivotally connected intermediate its ends to said crank assembly by a pin on one of said elongate slider link means and said crank assembly and a pivot slot on the other of said elongate slider link means and said crank assembly, said pin being received in said pivot slot.

21. An ice dispensing chute assembly as in claim 20, wherein said pin is on said crank assembly and said pivot slot is on said elongate slider link means.

* * * * *